United States Patent [19]

Link et al.

[11] 4,437,038

[45] Mar. 13, 1984

[54] HOLLOW CATHODE LAMP WITH IMPROVED STABILITY ALLOY FOR THE CATHODE

[75] Inventors: Vincent F. Link, Elmira; George K. Yamasaki, Horseheads, both of N.Y.

[73] Assignee: Westinghouse Electric Corp., Pittsburgh, Pa.

[21] Appl. No.: 43,529

[22] Filed: May 29, 1979

[51] Int. Cl.[3] ..... H01J 17/04

[52] U.S. Cl. ..... 313/633; 313/626

[58] Field of Search ..... 313/218, 209, 633, 626

[56] References Cited

U.S. PATENT DOCUMENTS

| | | | |
|---|---|---|---|
| 3,183,393 | 5/1965 | Paterson | 313/218 |
| 3,265,511 | 8/1966 | Sallo | 106/1 |
| 3,648,092 | 3/1972 | Wooldridge et al. | 313/209 |
| 3,855,491 | 12/1974 | Yamasaki | 313/209 X |
| 3,893,768 | 7/1975 | Stephens | 313/209 X |
| 3,898,501 | 8/1975 | Hosoya et al. | 313/178 |

*Primary Examiner*—David K. Moore

*Attorney, Agent, or Firm*—W. G. Sutcliff

[57] ABSTRACT

A hollow cathode type light source is provided having improved operating stability by forming the cathode of an alloy of a highly reactive, unstable prime metal of interest for spectral emission, and of a chemically stable, readily sputtered metal. An alloy of silver and calcium with a small amount of magnesium provides a hollow cathode device which exhibits stable operation after a minimum warm-up time.

3 Claims, 1 Drawing Figure

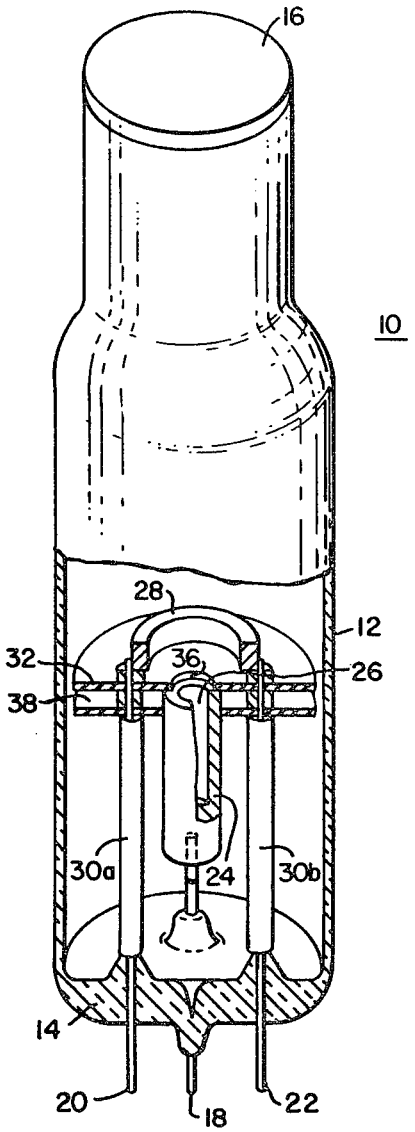
16
10
28
12
32
36
26
38
30a
24
30b
14
20
18
22

HOLLOW CATHODE LAMP WITH IMPROVED STABILITY ALLOY FOR THE CATHODE

BACKGROUND OF THE INVENTION

The present invention relates to spectral radiation or light sources and more particularly to hollow cathode spectral light sources. Such hollow cathode light sources are used to generate spectral line emission which is characteristic of the cathode material. This generated light is used in a variety of spectrophotometric chemical analysis techniques, such as atomic absorption spectroscopy, for identifying chemical samples and determining the sample material concentration.

The spectral light output from a hollow cathode light source is desirably stable after a short warm-up period to minimize testing changes during operation. For certain metallic cathode materials it is difficult to achieve stable operation without a long warm-up period which reduces the efficiency of the laboratory procedure. For highly reactive materials such as calcium this is a particular problem. Calcium is difficult to handle and machine because of its reactivity with air and moisture, and is difficult to out-gas during lamp manufacture without an extended seasoning process.

It has therefore been the practice to alloy calcium and other similarly reactive metals with a stable metal such as aluminum as taught in U.S. Pat. No. 3,183,393. It has also been the practice to include another metal such as magnesium in such calcium-aluminum alloy cathodes to provide a multi-element cathode and spectral emission capability.

When calcium has been alloyed with aluminum, and aluminum and magnesium, it has still required a long warm-up period to achieve a stable spectral output of less than 2% drift per 5 minute operation. It has also been necessary to repeatedly process and season such cathodes during the manufacturing process to achieve even this stability.

It has been known in the art to alloy silver with highly volatile cathode metals such as arsenic for the purpose of keeping the arsenic from volatilizing too rapidly from the cathode. These arsenic-silver alloy cathodes have typically employed about 40 weight percent arsenic and 60 weight percent silver.

SUMMARY OF THE INVENTION

A stable cathode metal alloy has been discovered which contains a first readily sputterable, chemical stable metal, and a second metal which provides the desired spectral line radiation, which second metal is readily chemically active and unstable. The first metal is selected from the group of silver, gold, rhodium, and copper. The second metal is selected from the group consisting of calcium, thallium, cadmium, antimony, bismuth, indium, selenium, tellunium, gallium, and zinc. This second metal is present in an amount of up to about 25 weight percent of the alloy.

A preferred alloy which has a minimum warm-up time needed to achieve stability contains about 6 weight percent calcium, about 3 weight percent of an addition stabilizing metal magnesium, and about 91 weight percent silver.

BRIEF DESCRIPTION OF THE DRAWINGS

The sole FIGURE is an elevation view, partly in section of a hollow cathode lamp which incorporates a cathode of the alloy of the present invention.

DESCRIPTION OF THE PREFERRED EMBODIMENTS

The invention can be best understood by reference to the embodiment seen in the sole FIGURE. A hollow cathode lamp 10, which is a source of spectral line radiation includes a generally tubular envelope 12, a base 14 at one end and a window 16 sealed to the other end. The window 16 is typically formed of ultraviolet transmissive glass or quartz, or similar material which efficiently transmits the shorter wavelength generated spectral radiation, such as the calcium 4227 Angstrom line.

Electrical lead-in 18, 20, and 22 are sealed through the glass insulating base 14. Lead-in 18 is electrically connected to the generally cylindrical cathode 24, which has a hollow chamber 26 at the far end. The electrical lead-in 20 and 22 are commonly electrically connected to a ring-shaped anode electrode 28 which is spaced from the hollow chamber end of the cathode. Electrical insulating tubing **30*a* and 30*b* is provided respectively about lead-ins 20 and 22 to prevent any electrical discharge between these lead-ins and the cathode as the lead-ins extend toward the anode. The discharge is further confined between the anode and the hollow portion of the cathode by a pair of insulating disks 32 and 38, which are disposed parallel to each other in a direction transverse to the cathode axis. The insulating disk 32 has a central aperture 36 which is generally aligned with the hollow open end of the cathode 24, with the disk 32 mounted from the lead-in 20 and 22 which pass therethrough. The disk 32 is mounted above the hollow open end of the cathode, generally between the ring anode 28 and the cathode 24, with the disk 32 approaching the envelope walls 12. The disk 34 is spaced from disk 32, and has a central aperture which accepts the cathode 24 therethrough. Disk 38 is likewise mounted from the lead-ins 20 and 22 which extend therethrough. Disk 38** has been found useful to insure that the spectral light producing discharge is confined between the anode and the hollow portion of the cathode.

The cathode 24 is preferably formed of an alloy which is predominantly of a first metal which is chemically stable, readily sputtered, and has good metal working and casting capability. The first metal is present in an amount greater than 50 weight percent of the alloy and is selected from the group consisting of silver, copper, gold, and rhodium. The alloy contains a second metal which provides the desired spectral line radiation of interest, and which in its pure form is readily chemically active and unstable. The second metal is selected from the group consisting of calcium, thallium, cadmium, antimony, bismuth, indium, selenium, tellurium, gallium, and zinc. A third metal such as magnesium may be added to improve the stability of the first and second metal alloy.

When calcium is the second metal which is the source of the spectral line radiation of interest, a preferred highly stable alloy consists of 6 weight percent calcium, 3 weight percent magnesium, and 91 weight percent silver. The silver is highly stable and easily sputtered, and permits casting of a cylinder which can be machined to form the cathode hollow portion.

The alloy is typically made by mixing the individual alloy metals in an induction heated crucible, which mixing takes place after liquification of the metals. Such heating is carrying out in an inert atmosphere. The mixed alloy is then cast as the cylindrical rod. The cathode with a hollow portion can thereafter be machined.

The calcium may be present in the alloy with silver in amounts up to about 25 weight percent, the magnesium in amounts up to about 20 weight percent, with the remainder and predominate alloy constituent being silver. Other chemically stable, easily sputtered metals which are readily alloyed and formable into alloy metal hollow cathodes include copper, gold and rhodium. When these chemically stable, easily sputtered metals are the major constituent of the alloy, the cathode hollow will continuously expose a fresh surface at a uniform rate determined by the sputtering rate of these major constituents. The less stable, chemically active metal which generates the desired spectral line radiation is evolved as the alloy major constituent sputters.

Hollow cathode lamps made with the alloys described herein exhibit stable operation after a minimum of warm-up, typically less than ten minutes. Such lamps are not subject to the previously observed high manufacturing rejection rates occasioned by operating instabilities.

The spectral line radiation generated by a hollow cathode lamp is typically used in atomic absorption spectrophotometry. The atomic absorption instrument can have different bandpass characteristics. For a wide bandpass instrument the co-alloying metals must only include metals which have emission lines sufficiently far from the line of interest such as the 4227 Angstrom line of calcium. The silver and magnesium co-alloying metals meet the restriction and do not offer interfering lines near the line of interest. Thus, silver is advantageously used with thallium, and cadmium, while a zinc-copper alloy is advantageous.

We claim:

1. A spectral radiation source of the hollow cathode type comprising an anode and cathode positioned within a gas filled envelope, with the operating discharge between the anode and the cathode generating spectral radiation which is characteristic of the metal cathode, the improvement wherein the metal cathode, consists of an alloy of silver which is chemically stable and readily sputtered, and calcium in an amount of up to about 25 weight percent of the alloy.

2. The spectral radiation source set forth in claim 1, wherein magnesium is included in the alloy in an amount up to 20 weight percent of the alloy.

3. The spectral radiation source set forth in claim 2, wherein the metal cathode alloy consists of about 91 weight percent silver, about 6 weight percent calcium, and about 3 weight percent magnesium.

* * * * *